US005286311A

United States Patent [19]

Schüler et al.

[11] Patent Number: 5,286,311

[45] Date of Patent: * Feb. 15, 1994

[54] PRECIPITATION HARDENING FERRITIC-PEARLITIC STEEL VALVE

[75] Inventors: Volker Schüler, Krefeld; Klaus E. Richter, Nauheim, both of Fed. Rep. of Germany

[73] Assignee: Thyssen Edelstahlwerke AG, Fed. Rep. of Germany

[ * ] Notice: The portion of the term of this patent subsequent to Jun. 22, 2010 has been disclaimed.

[21] Appl. No.: 975,020

[22] Filed: Nov. 12, 1992

Related U.S. Application Data

[63] Continuation of Ser. No. 794,380, Nov. 15, 1991, Pat. No. 5,221,373, which is a continuation of Ser. No. 536,405, Jun. 11, 1990, abandoned.

[30] Foreign Application Priority Data

Jun. 9, 1989 [DE] Fed. Rep. of Germany ..... 3918869
May 2, 1990 [DE] Fed. Rep. of Germany ..... 4014072

[51] Int. Cl.[5] ..... C22C 38/12
[52] U.S. Cl. ..... 148/328; 148/333
[58] Field of Search ..... 148/320, 328, 333; 420/104, 127

[56] References Cited

U.S. PATENT DOCUMENTS 4,838,963 6/1989 Huchtemann et al. ..... 420/104

FOREIGN PATENT DOCUMENTS 0159119 8/1988 European Pat. Off. .
1958548 12/1970 Fed. Rep. of Germany .
2113418 10/1971 Fed. Rep. of Germany .
2116357 2/1972 Fed. Rep. of Germany .
1608162 6/1972 Fed. Rep. of Germany .
2333183 4/1974 Fed. Rep. of Germany .
2334974 7/1974 Fed. Rep. of Germany .
2529799 1/1976 Fed. Rep. of Germany .
2830850 1/1979 Fed. Rep. of Germany .
2819227 11/1979 Fed. Rep. of Germany .
3719569 1/1988 Fed. Rep. of Germany .
2023915 8/1970 France .
2087818 12/1971 France .
2274704 1/1976 France .
51-6811 of 1976 Japan .
556456 1/1980 Japan ..... 420/104
56-38448 of 1981 Japan .
57-016114 of 1982 Japan .
58-52458 of 1983 Japan .
59-37737 of 1984 Japan .
61-235541 of 1986 Japan .
61-264129 of 1986 Japan .
61-264162 of 1986 Japan .
1244360 of 1971 United Kingdom .

OTHER PUBLICATIONS

"Mikrolegieren von Stahl" Tagungsbericht Entwickeln und Verdeln von Konstructionswerkst. Leipzig 1984 pp. 68–77.

Lutz Meyer "Mikrolegierunselemente im Stahl" Thyssen Technische Berichte, No. 1/84, pp. 34–44.

Christian Strassburger and Lutz Meyer "Wege zur Weiterentwicklung von unlegierten Barstahlen", Thyssen-Forschung 1971, Nos. 1 and 2, pp. 2–7.

B. L. Biggs, "Austenitic grain-size control of medium carbon steels", Journal of the Iron and Steel Inst., Aug. 1959, pp. 361–367.

(List continued on next page.)

*Primary Examiner*—Deborah Yee
*Attorney, Agent, or Firm*—Cushman, Darby & Cushman

[57] ABSTRACT

A precipitation hardening ferritic-pearlitic steel containing:

0.20 to 0.60% carbon
0.20 to 0.95% silicon
0.50 to 1.80% manganese
0.004 to 0.04% nitrogen
0.05 to 0.20% vanadium and/or niobium
0 to 0.20% sulfur
0 to 0.70% chromium
0 to 0.10% aluminum
0 to 0.05% titanium balance iron and incidental impurities. The steel is useful for valves in internal combustion engines.

2 Claims, 7 Drawing Sheets

OTHER PUBLICATIONS

H. Osuzu et al. "Application of Microalloyed Steels of Achgievc. High Toughness in Hot Forged Components without Further Heat Treatments", SAE Technical Paper Series, Int'l Congr., Feb. 1968, pp. 1-11.

L. J. Cuddy and J. C. Raley, "Austenite Grain Coarsening in Microalloyed Steels", Metallurgical Transactions A, vol. 1'4, Oct. 1983, pp. 1989-1995.

E. P. Houdremont, Handbuch, d. Sonderstahlkunde. III. Auflage, zweiter Band, pp. 1410-1422, 1956.

H. Baumgart, "Verbesserung der Zahligkeitseignes-chaften in der Warmeeinflusszone von Schweissverbindungen Dissertation, Universitat Clausthal", Jun. 1984.

Journal of the Japan Society for Heat Treatment 1984, No. 5, pp. 264-267.

Technical Report Mar. 1983 SKF Steel, pp. 3-23.

Steel A = 14718 17.5 mm diameter, standard hardening and tempering

Steel B = AFP steel, condition as delivered (BY/drawn/ground) 9.32 mm diameter

Steel A = 14718 17.5 mm diameter, standard hardening and tempering

Steel B = AFP steel, condition as delivered (BY/drawn/ground) 9.32 mm diameter

PRECIPITATION HARDENING FERRITIC-PEARLITIC STEEL VALVE

This is a continuation of application Ser. No. 07/794,380, filed Nov. 15, 1991, now U.S. Pat. No. 5,221,373 which is a continuation of Ser. No. 07/536,405 filed Jun. 11, 1990, now abandoned.

The present invention relates to a precipitation hardenable ferritic-pearlitic steel ("AFP steel") which is especially useful as a material for valves of internal combustion engines.

BACKGROUND OF THE INVENTION

The inlet and outlet valves of internal combustion engines control the transfer of gases into and out of the engine and seal the engine. The development of engines with increasingly high power increases the stresses on the valves, especially the outlet valves. The outlet valves may reach operating temperatures of about 850° C. Inlet valves are operated at lower temperatures because of the flow of cool fuel mixtures and seldom reach temperatures above 550° C.

Because of these operating conditions, the materials used in the valves must have high thermal resistance. Other requirements for valves are shown in FIG. 1. See V. Schüler, T. Kreul, S. Engineer: "Special Quality Constructional Steels in Motorcars", Thyssen Technischen Berichte 2 (1986), pages 233–240.

Special valve materials have been developed to provide these properties, as specified by DIN 17480. See "Valve Materials", Beuth Verlag GmbH, Berlin 30 (September 1984). Three categories of material are used for this purpose:

martensitic-carbidic steels, such as materials Nos. 1.4718, 1.4731, 1.4748.

austenitic-carbidic steels, some of them precipitation hardenable, such as materials Nos. 1.4873, 1.4875, 1.4882, 1.4785 and austenitic-precipitation hardenable alloys, such as materials Nos. 2.4955, 2.4952.

When designing valves subjected to different loads, valve manufacturers take into account the properties of the valve materials. For example, lightly loaded inlet valves are frequently produced from a single metal, e.g. 1.4719 (X 45 CrSi 9 3). These are called monovalves. Hardened and tempered ground rods are, for example, partially heated and hot formed into a pear shape. Then the valve disc is formed by drop forging. This is followed by hardening and tempering, and, then, the final machining.

In the case of heavily stressed outlet valves, valve materials often find it necessary to combine materials appropriately with one another. As shown in FIG. 1, which illustrates a bimetallic valve, the high heat resistance and resistance to hot gas corrosion of precipitation hardenable austenitic steel can be combined with the high wear resistance to and the low friction properties of hardenable martensitic steel and, by friction welding, a valve disc of steel 1.4871 (X 53 CrMnNiN 2 1 9) and steel 1.4718 (X 45 CrSi 9 3)

In the present state of the art, more than half the total valve material requirements for inlet valves and lightly-stressed outlet valves, and also for the stems of bimetallic inlet and outlet valves, are met with steel 1.4718 (X 45 CrSi 9 3) or modifications of that material. These steels are processed by steel and valve manufacturers in accordance with the production sequence shown in FIGS. 2 and 3.

SUMMARY OF THE INVENTION

The object of the present invention is to replace the previously-used martensitic carbidic steels, which must be subjected to several thermal treatments by steel and valve manufacturers, with steel which require little if any thermal treatment and which are less expensive to machine.

These and other objects of the invention are achieved by precipitation hardening of ferritic-pearlitic steels of the following composition:

0.20 to 0.60% carbon
0.20 to 0.95% silicon
0.50 to 1.80% manganese
0.004 to 0.04% nitrogen
0.05 to 0.20% vanadium and/or niobium
0 to 0.20% sulfur
0 to 0.70% chromium
0 to 0.10% aluminum
0 to 0.05% titanium
balance iron and incidental impurities.

A preferred composition is:

0.20 to 0.60% carbon
20 to 0.95% silicon
0.50 to 1.80% manganese
0.004 to 0.04% nitrogen
0.05 to 0.20% vanadium and/or niobium
balance iron and incidental impurities.

The just-mentioned steels may contain, singly or in combination, up to 0.20% sulfur, up to 0.70% chromium, up to 0.10% aluminum, and/or up to 0.05% titanium.

A further preferred composition is a steel containing 0.35 to 0.50% carbon
0.40 to 0.80% silicon
1.00 to 1.60% manganese
0.05 to 0.50% chromium
0.01 to 0.05% aluminum
0.008 to 0.03% nitrogen
0.05 to 0.12% vanadium
0 to 0.05% sulfur
0 to 0.05% niobium
0 to 0.025% titanium
balance iron and incidental impurities.

A preferred form of the just-mentioned composition is a steel containing 0.35 to 0.50% carbon
0.40 to 0.80% silicon
1.00 to 1.60% manganese
0.05 to 0.50% chromium
0.01 to 0.05% aluminum
0.008 to 0.03% nitrogen
0 05 to 0.12% vanadium
balance iron and incidental impurities.

The foregoing steel may contain, individually or in combination, up to 0.05% sulfur, up to 0.05% niobium and/or up to 0.025% titanium.

It has been found that, after rolling into wire and after upsetting or forging with cooling from a hot shaping temperature in air, the foregoing AFP steels of the invention have mechanical and thermal properties which are comparable with those of steel 1.4718.

BRIEF DESCRIPTION OF FIGURES OF DRAWING

DETAILED DESCRIPTION OF PREFERRED EMBODIMENTS

Figure 4:
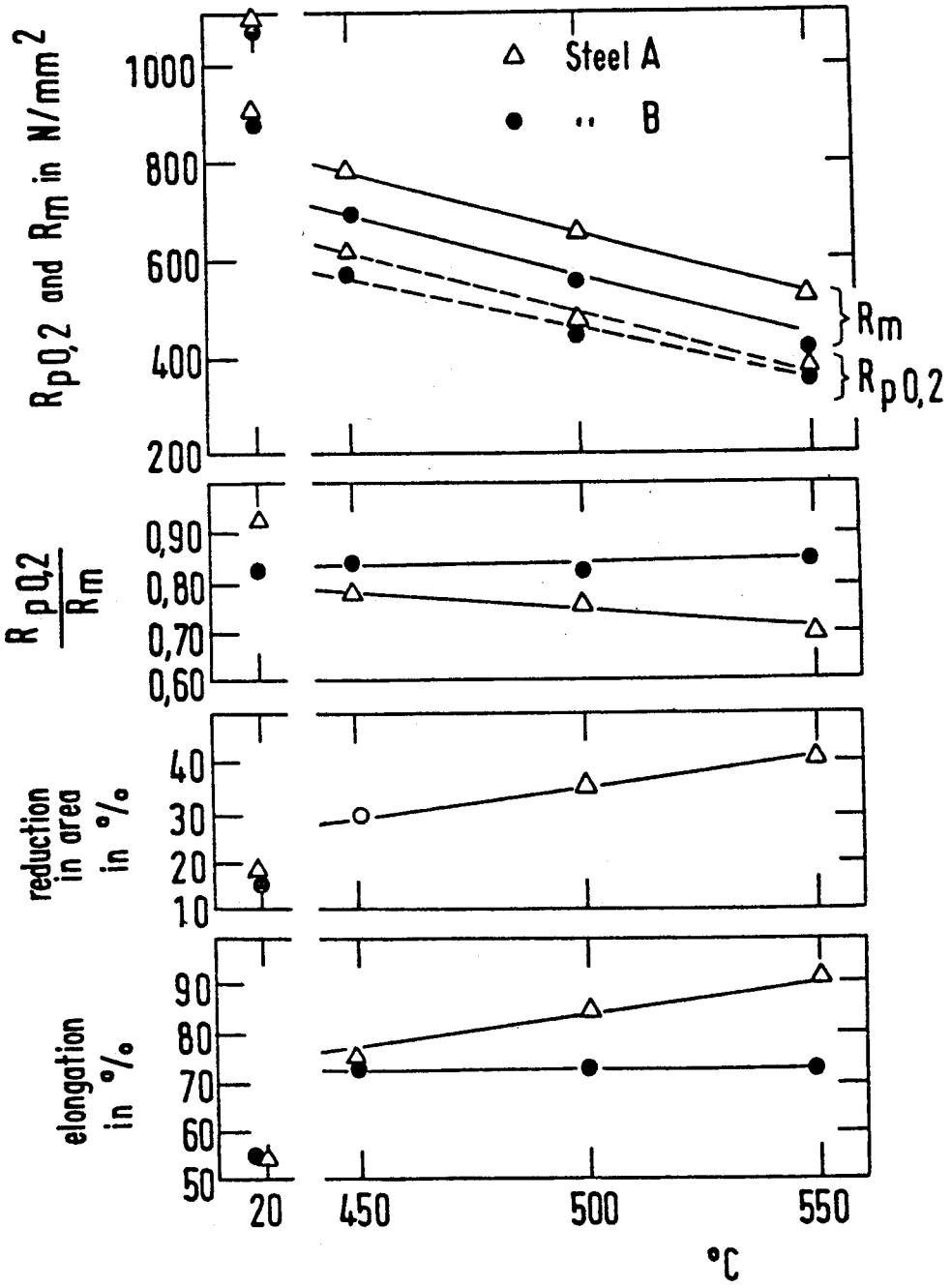
FIG. 4 is a graph which shows the strength properties of steel 1.4718 and steels according to the invention.
Figure 5:
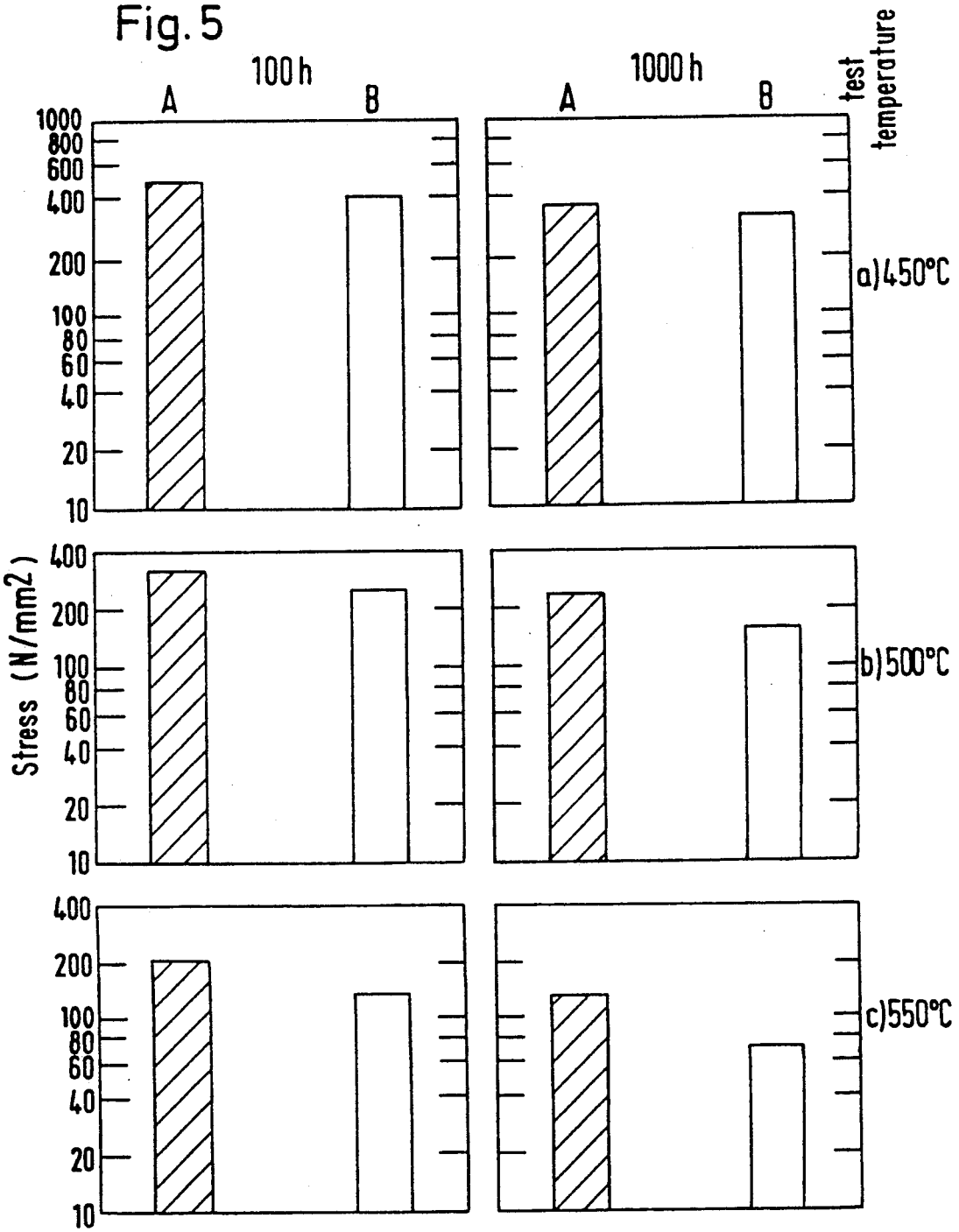
FIG. 5 is a graph which shows the creep rupture strength of steel 1.4718 and a steel according to the invention.

Table 1 shows the chemical composition of a steel 1.4718 and of a steel according to the invention. Table 2 and FIG. 4 show the strength properties of these steels at room temperature and at elevated temperatures. Table 3 and FIG. 5 characterize the creep rupture strength of the comparison materials 1.4718 (X 45 CrSi 93) and a steel according to the invention and show that, in the BY condition, the AFP steels of the invention are a desirable alternative to the prior art steel 1.4718.

TABLE 1

Comparison of Compositions of Steels: 1.4718 (× 45 CrSi 93) and AFP Steel Chemical Composition - melt analyses % by weight

| | Steel 1.4718 A | AFP-Steel B |
|---|---|---|
| C | 0.44 | 0.43 |
| Si | 2.78 | 0.66 |
| Mn | 0.32 | 1.38 |
| P | 0.015 | 0.006 |
| S | 0.003 | 0.027 |
| Cr | 8.93 | 0.15 |
| Mo | 0.12 | 0.02 |
| Ni | 0.20 | 0.08 |
| Y | 0.03 | 0.12 |
| W | 0.02 | <0.01 |
| Al | 0.027 | 0.047 |
| B | — | <0.0004 |
| Co | 0.06 | 0.008 |
| Cu | 0.04 | 0.10 |
| N | 0.018 | 0.016 |
| Nb | <0.005 | <0.005 |
| Ti | <0.003 | <0.003 |
| Sn | <0.003 | 0.012 |
| As | 0.009 | 0.010 |

TABLE 2

Comparison of Properties of Steels
Strength Properties at Room Temperature and Elevated Temperature
A = 1.4178 (See Table 1 for Composition Standard Hardening and Tempering
B = AFP Steel (See Table 1 for Composition BY/Drawn/Ground 9.32 mm diameter

| Steel | °C. | $R_p$ 0.2 N/mm² | $R_p$ 1.0 N/mm² | $R_m$ N/mm² | $R_p$ 0.2 / $R_m$ | $A_5$ % | Z % |
|---|---|---|---|---|---|---|---|
| A | 20 | 899 | 959 | 1098 | 0.93 | 18.0 | 53.5 |
| | 450 | 611 | 706 | 776 | 0.78 | 26.8 | 76.0 |
| | 500 | 472 | 584 | 638 | 0.74 | 34.0 | 84.0 |
| | 550 | 344 | 440 | 510 | 0.67 | 38.3 | 90.1 |
| B | 20 | 876 | — | 1069 | 0.82 | 14.5 | 54.0 |
| | 450 | 564 | 651 | 681 | 0.83 | * | 72.0 |
| | 500 | 433 | 529 | 536 | 0.81 | * | 70.0 |

TABLE 2-continued

Comparison of Properties of Steels
Strength Properties at Room Temperature and Elevated Temperature
A = 1.4178 (See Table 1 for Composition Standard Hardening and Tempering
B = AFP Steel (See Table 1 for Composition BY/Drawn/Ground 9.32 mm diameter

| Steel | °C. | $R_p$ 0.2 N/mm² | $R_p$ 1.0 N/mm² | $R_m$ N/mm² | $R_p$ 0.2 / $R_m$ | $A_5$ % | Z % |
|---|---|---|---|---|---|---|---|
| | 550 | 337 | 399 | 400 | 0.84 | * | 70.0 |

*Breakage outside the measuring mark zone

TABLE 3

Comparison of Steels
1.4718 (× 45 CrSi 93) and AFP Steel
Creep Rupture Strength at 450, 500 and 550° C. for $10^2$ and $10^3$ hours duration of stressing
A = 1.4718 17.5 mm diameter; standard hardening and tempering
B = AFP Steel; BY/drawn/ground D = steel 9.32 mm diameter

| Steel | °C | $10^2$ Hrs | $10^3$ Hrs |
|---|---|---|---|
| A | 450 | 500 | 380 |
| | 500 | 330 | 230 |
| | 550 | 210 | 130 |
| B | 450 | 410 | 310 |
| | 500 | 260 | 150 |
| | 550 | 140 | 70 |

After upsetting and die-forging, inlet valves produced by a valve manufacturer from AFP steels according to the present invention were cooled in air and tested in engines without any further heat treatment. The results are good and adequate in comparison with valves made of steel 1.4718.

Figure 1:
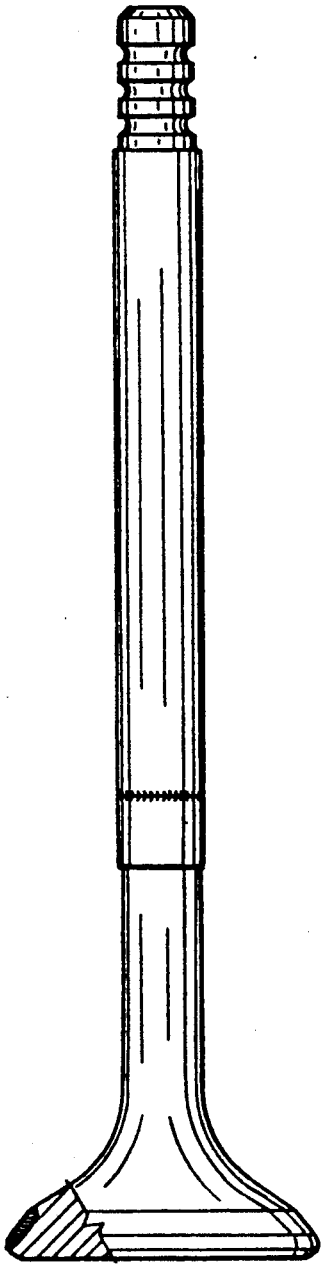
FIG. 1 is an elevation, partly in section, of a bimetallic internal combustion engine outlet valve.
Figure 2:
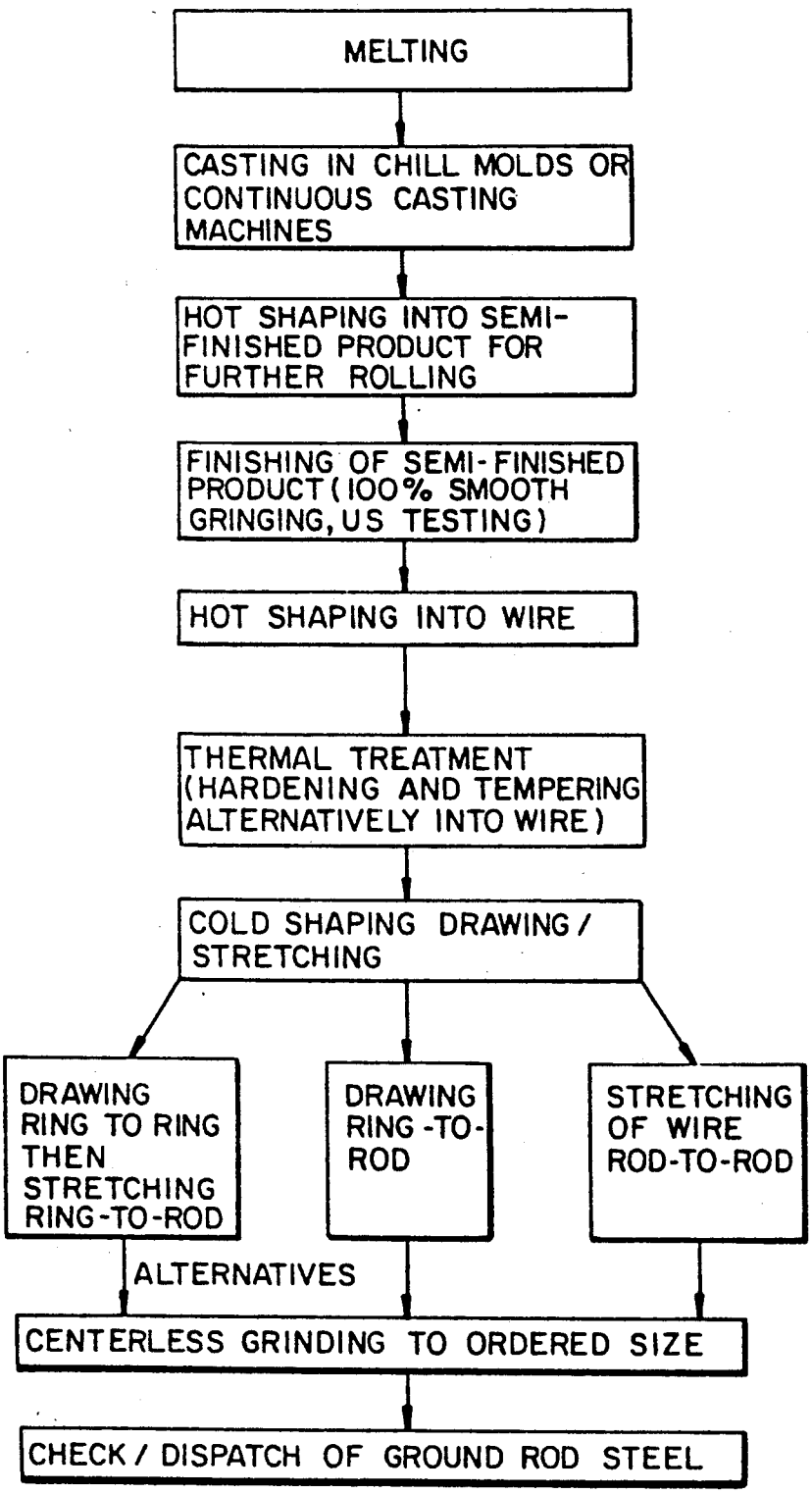
FIG. 2 is a flow chart of processing of prior art steels.
Figure 3:
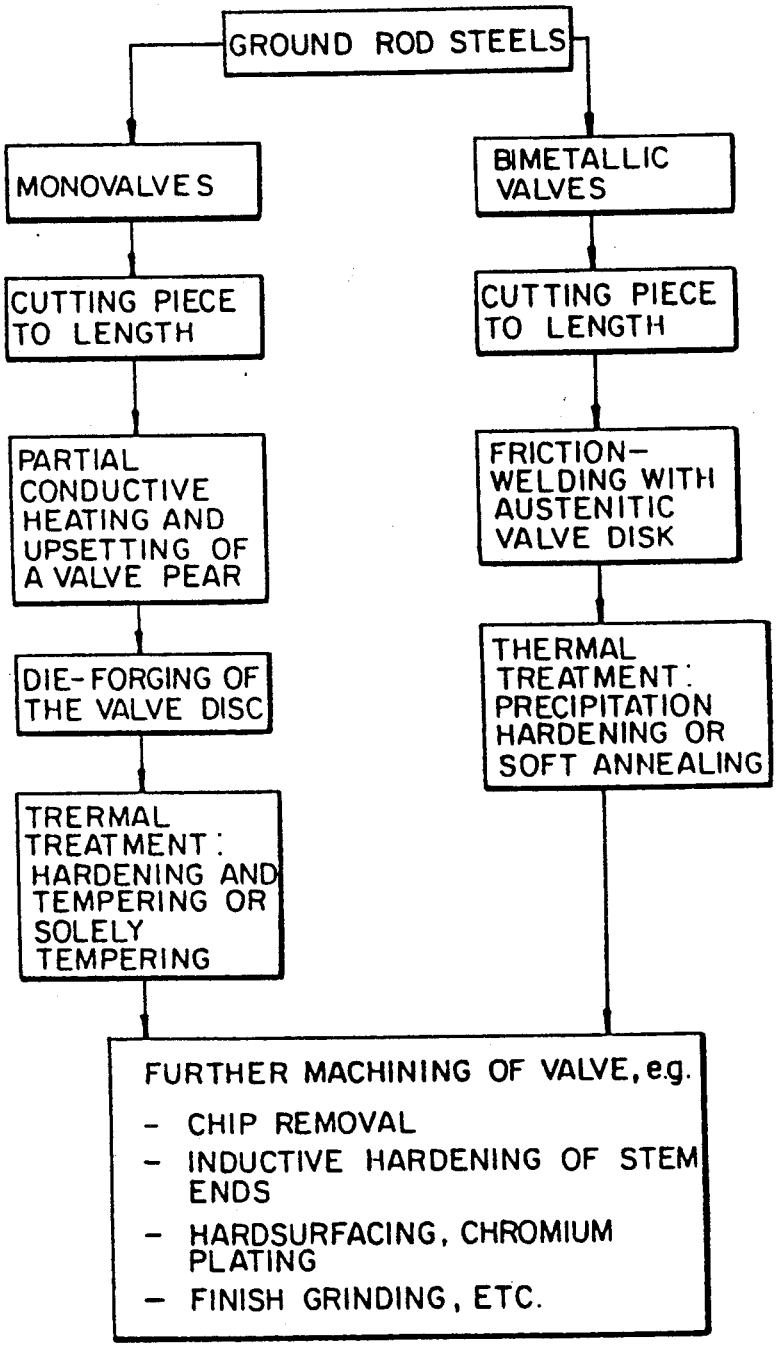
FIG. 3 is a flow chart of the processing of Martensitic valve steels into valves.
Figure 6:
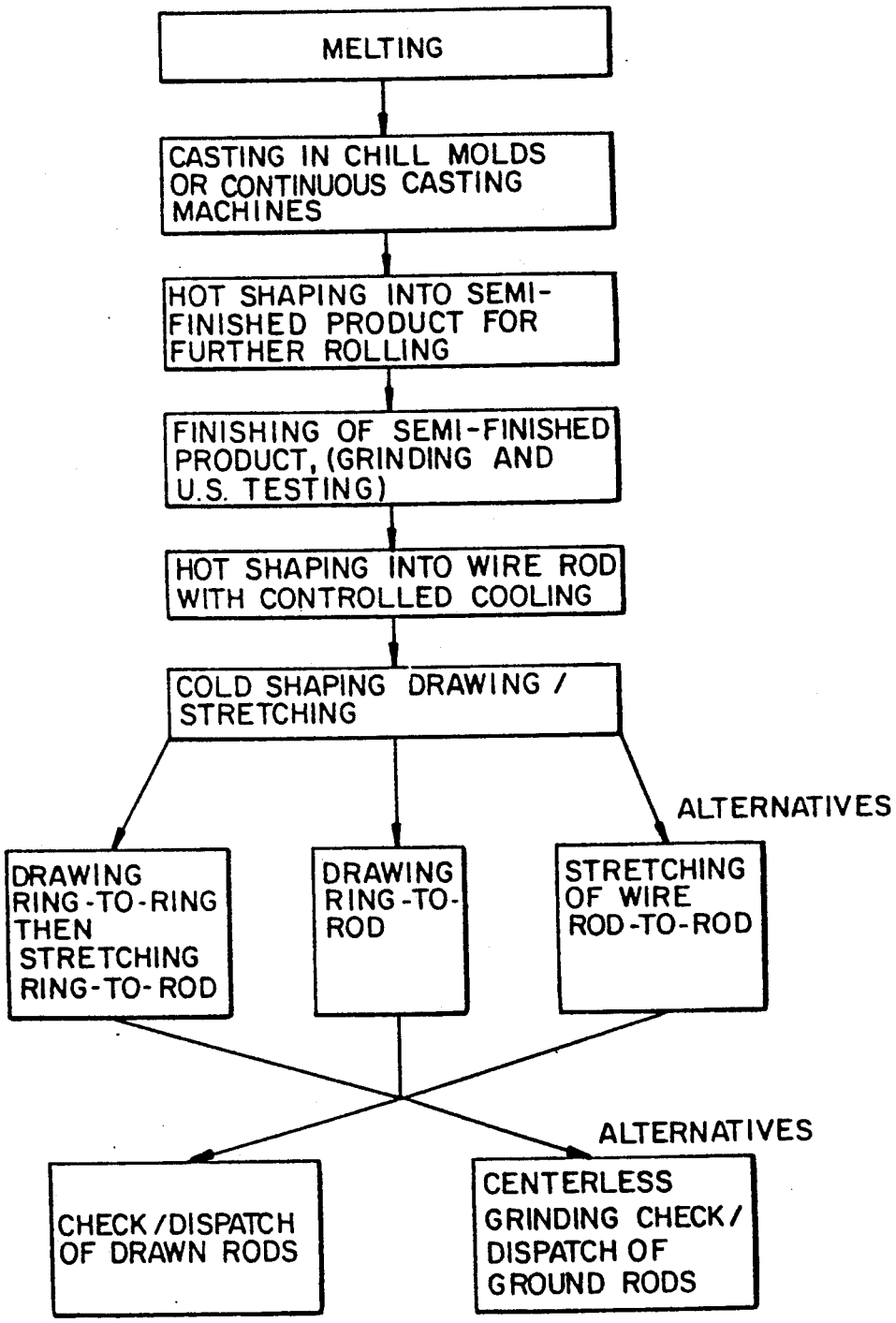
FIG. 6 is a flow chart of processing of AFP steels into valves.
Figure 7:
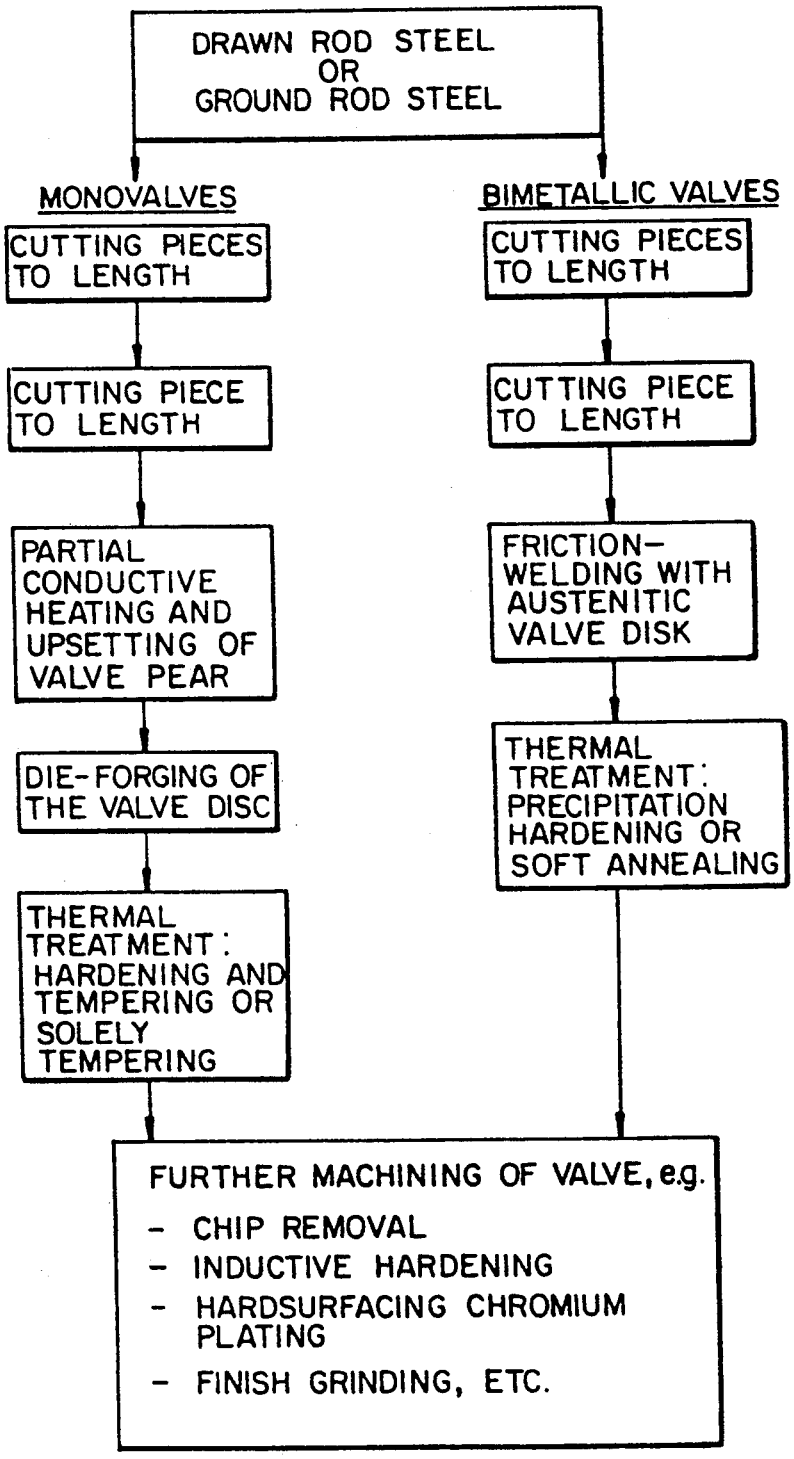
FIG. 7 is a flow chart showing the steps of prior art valve manufacturing methods.

Steels according to the invention therefore have the advantage that they can be produced easily and economically by the manufacturing sequence shown in FIGS. 6 and 7. When this manufacturing sequence is compared with the prior art manufacturing sequence shown in FIGS. 2 and 3, it can be seen that the AFP steels of the present invention do not require thermal treatments needed with previously-used steels.

The steels of the present invention have a further advantage because of lower sensitivity to cracking and decarburization as compared to steel 1.4718, and also because of the absence of decarburization through the elimination of thermal treatments. The 100% smooth grinding of the semifinished product for further rolling, presently required by steel 1.4718, is replaced by partial grinding of the AFP steels of the present invention. Moreover, machining by centerless grinding can be reduced or even completely eliminated, if drawn rods of the AFP steels of the invention are substituted for ground rods of steel 1.4718.

In addition to lower sensitivity to cracking and decarburization, the AFP steels of the invention have the following further advantages over martensitic carbide valve steels:

- less expensive alloying costs
- improved castability
- lower sensitivity to coarse-grained recrystallization
- improved machinability As a whole, these advantages mean that the use of the AFP steels of the present invention for internal combustion engine valves provides substantial savings in costs to both steel producers and valve manufacturers.

What is claimed is:

1. An inlet or outlet internal combustion engine valve useful to control transfer of gases into and out of the engine and seal the engine, said valve being composed of precipitation hardening ferritic-pearlitic steel containing:

| | |
|---|---|
| 0.20%-0.60% | carbon |
| 0.20% to 0.95% | silicon |
| 0.50 to 1.80% | manganese |
| 0.004 to 0.04% | nitrogen |
| 0.05 to 0.20% | vanadium and/or niobium |

-continued

| | |
|---|---|
| 0 to 0.20% | sulfur |
| 0 to 0.70% | chromium |
| 0 to 0.10% | aluminum |
| 0 to 0.05% | titanium |

balance iron and incidental impurities.

2. A valve according to claim 1 in which the steel contains at least one member of the group consisting of sulfur, chromium, aluminum and titanium, the maximum amount of said member being 0.20% in the case of sulfur, 0.70% in the case of chromium, 0.10% in the case of aluminum and 0.05% in the case of titanium.

* * * * *